US007775758B2

(12) United States Patent
Legare

(10) Patent No.: US 7,775,758 B2
(45) Date of Patent: Aug. 17, 2010

(54) IMPELLER REAR CAVITY THRUST ADJUSTOR

(75) Inventor: Pierre-Yves Legare, Chambly (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 759 days.

(21) Appl. No.: 11/674,685

(22) Filed: Feb. 14, 2007

(65) Prior Publication Data

US 2008/0193277 A1 Aug. 14, 2008

(51) Int. Cl.
*F01D 3/00* (2006.01)
*F04D 29/40* (2006.01)

(52) U.S. Cl. ..... 415/1; 415/98; 415/105; 415/108; 415/170.1; 415/198.1

(58) Field of Classification Search ..... 415/1, 415/98, 104, 105, 106, 108, 170.1, 198.1
See application file for complete search history.

(56) References Cited

U.S. PATENT DOCUMENTS 2,659,312 A 11/1953 Wahle
2,925,290 A 2/1960 Greenwald
3,123,010 A * 3/1964 Witt et al. ..... 415/173.1
3,506,373 A 4/1970 Danker et al.
3,565,543 A 2/1971 Mrazek
3,874,812 A 4/1975 Hanagarth
3,965,699 A * 6/1976 Bracken, Jr. ..... 416/170 R
4,378,196 A * 3/1983 Leskinen ..... 415/104
4,578,018 A 3/1986 Pope
4,820,115 A * 4/1989 Bandukwalla ..... 415/98
4,822,240 A 4/1989 Marshall
4,854,830 A 8/1989 Kozawa et al.
4,969,797 A 11/1990 Takara et al.
5,137,418 A 8/1992 Sieghartner
5,167,678 A * 12/1992 Elonen et al. ..... 96/214
5,320,482 A 6/1994 Palmer et al.
5,489,187 A * 2/1996 Ray ..... 415/111
5,605,434 A * 2/1997 Haag et al. ..... 415/106
5,862,666 A 1/1999 Liu
6,129,507 A 10/2000 Ganelin
6,193,462 B1 2/2001 Kubota
6,276,896 B1 * 8/2001 Burge et al. ..... 415/115
7,252,474 B2 * 8/2007 Belokon et al. ..... 415/1

* cited by examiner

*Primary Examiner*—Igor Kershteyn
(74) *Attorney, Agent, or Firm*—Ogilvy Renault LLP

(57) ABSTRACT

An apparatus for adjusting a thrust load on a rotor assembly of a gas turbine engine includes an impeller rear cavity defined between a rear face of an impeller of the rotor assembly and a stationary wall spaced axially apart from the rear surface of the impeller. A pressurized air flow with a tangential velocity is introduced into the impeller rear cavity at a tip of the impeller to pressurize the cavity. Means are provided in the cavity for directly interfering with the tangential velocity of the pressurized air flow to affect an average static pressure of the pressurized air flow within the cavity in order to adjust the thrust load on the rotor assembly caused by the average static pressure in the cavity.

10 Claims, 3 Drawing Sheets

IMPELLER REAR CAVITY THRUST ADJUSTOR

TECHNICAL FIELD

The invention relates generally to gas turbine engines, and more particularly to gas turbine engines having improved thrust bearing load control.

BACKGROUND OF THE ART

Gas turbine engines such as those used as aircraft turbojets or turbofans typically comprise a rotating fan, compressor and turbine that are axially mounted to one or more coaxial shafts for rotation about a central axis of the engine. The shafts are rotatably supported by at least two bearing assemblies and the front-most bearing assembly in the direction of fluid flow in the engine also prevents axial movement of the shaft within the engine case and is referred to as a "thrust bearing assembly". Despite thrust bearing assemblies typically being machined to tight tolerances, a small amount of axial play in the thrust bearing assembly exists. This play is undesirable as it causes noise and vibration of the engine when the engine is in operation. Much of this play can be eliminated by exerting a forward load on the bearing, for example by pressurized air from the compressor. A forward force caused by the pressurized air from the compressor is exerted on the rear portion of the compressor section and is transferred through the shafts to the thrust bearing assembly. However, due to size constraints on the engine and performance requirements of the compressor section, the amount of pressure exerted in conventional engine designs, may not provide adequate forward load on the thrust bearing assembly.

Accordingly, an apparatus for adjusting a thrust load on a rotor assembly for a gas turbine engine is desirable in order to improve thrust bearing load control.

SUMMARY OF THE INVENTION

It is therefore an object of this invention to provide an apparatus and method for adjusting a thrust load on a rotor assembly of a gas turbine engine.

In one aspect, the present invention provides an apparatus for adjusting a thrust load on a rotor assembly of a gas turbine engine, the rotor assembly including a compressor having an impeller for pressurizing air in the engine, the apparatus comprising an impeller rear cavity defined between a rear face of the impeller and a stationary wall spaced axially apart from the rear face of the impeller, the impeller rear cavity being in fluid communication at a tip of the impeller with pressurized air from the impeller tip to introduce a pressurized air flow with a tangential velocity from the impeller tip into the impeller rear cavity; and means for directly interfering with the tangential velocity of the pressurized air flow to affect an average static pressure of the pressurized air flow within the impeller rear cavity, the means being affixed within the impeller rear cavity.

In another aspect, the present invention provides a gas turbine engine comprising a rotor assembly including a shaft, a turbine and a compressor affixed to the shaft, the compressor having an impeller for pressurizing air in the engine; a combustion section in fluid communication with pressurized air from the compressor; a cavity defined between a rear face of the impeller and a stationary wall spaced axially apart from the rear face of the impeller, the cavity being in fluid communication at a tip of the impeller with pressurized air from the impeller tip to introduce a pressurized air flow with a tangential velocity from the impeller tip into the cavity, the cavity being in fluid communication at a location radially, inwardly away from the impeller tip with a low pressure region for extracting an air flow from the cavity; and a plurality of velocity interfering members attached to the stationary wall and protruding axially into the cavity to reduce the tangential velocity of the pressurized air flow within the cavity.

In a further aspect, the present invention provides a method for adjusting a thrust load on a rotor assembly of a gas turbine engine, the rotor assembly including a compressor having an impeller for pressurizing air in the engine, the compressor defining a cavity between a rear face of the impeller and a stationary wall spaced axially apart from the rear face of the impeller, to introduce a pressurized air flow with a tangential velocity from the impeller tip into the cavity, the method comprising a step of injecting a high pressure air flow through at least one opening in the stationary wall into the cavity in a direction selected to be substantially the same as or opposite to a direction of the tangential velocity of the pressurized air flow introduced from the impeller tip into the cavity, depending on a desired adjustment result of the thrust load.

Further details of these and other aspects of the present invention will be apparent from the detailed description and drawings included below.

DESCRIPTION OF THE DRAWINGS

Reference is now made to the accompanying drawings depicting aspects of the present invention, in which.

DETAILED DESCRIPTION OF THE PREFERRED EMBODIMENTS

Figure 1:
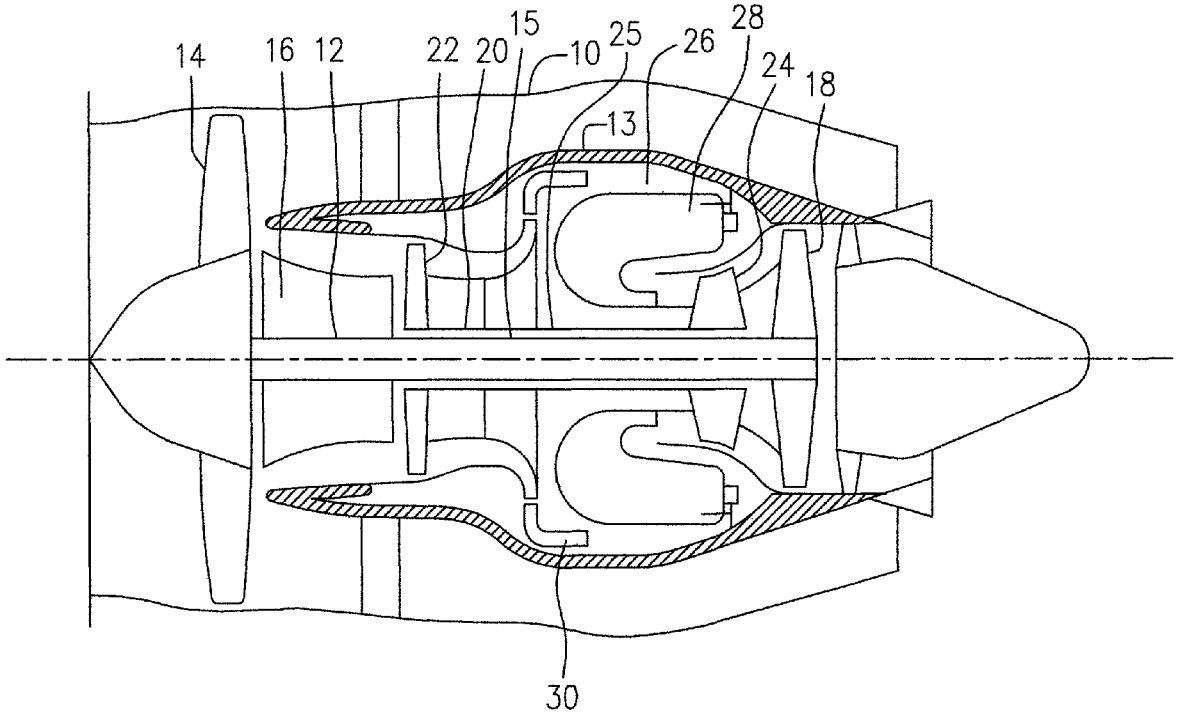
FIG. 1 is a schematic cross-sectional view of a turbofan gas turbine engine as an example illustrating an application of the present invention.

Referring to FIG. 1, a turbofan gas turbine engine incorporating an embodiment of the present invention is presented as an example of the application of the present invention, and includes a housing 10, a core casing 13, a low pressure spool assembly seen generally at 12 which includes a shaft 15 interconnecting a fan assembly 14, a low pressure compressor 16 and a low pressure turbine assembly 18, and a high pressure spool assembly seen generally at 20 which includes a shaft at 25 interconnecting a high pressure compressor assembly 22 and a high pressure turbine assembly 24. The core casing 13 surrounds the low and high pressure spool assemblies 12 and 20 in order to define a main fluid path (not indicated) therethrough. In the main fluid path there are provided a combustion section 26 having a combustor 28 therein. Pressurized air provided by the high pressure compressor assembly 22 through a diffuser 30 enters the combustion section 26 for combustion taking place in the combustor 28.

Figure 2:
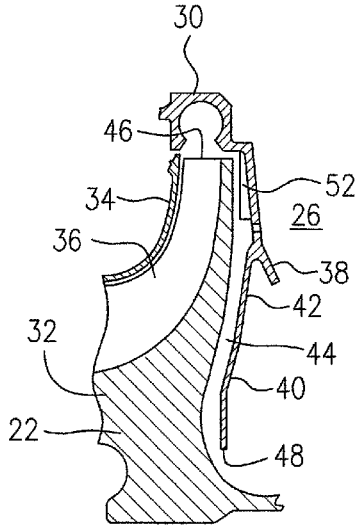
FIG. 2 is a partial cross-sectional view of an apparatus according to one embodiment of the present invention, for adjusting a thrust load on a rotor assembly of the gas turbine engine of FIG. 1.
Figure 3:
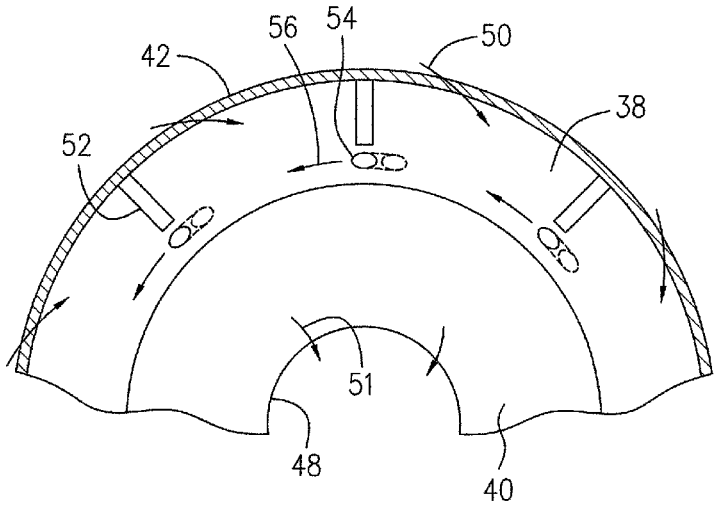
FIG. 3 is partial front elevational view of a stationary wall used in the apparatus of FIG. 2.

Referring to FIGS. 1-3, the high pressure compressor assembly 22 includes an impeller 32 as a final stage thereof, rotating within an impeller shroud 34. An air flow which has been pressurized in turn by the fan assembly 14, low pressure compressor 16 and upstream stages of the high pressure compressor 22, enters the impeller shroud 34 and is further compressed by blades 36 of the impeller 32 and is then discharged through the diffuser 30 into the combustion section 26 within the core casing 13.

The diffuser 30 is affixed to an annular diffuser casing 38 (partially shown in FIG. 2) which forms a partition between the high pressure compressor assembly 22 and the combustion section 26 such that pressurized air discharged from the diffuser 30 (typically referred to as P3 air) is maintained at a high pressure around the combustor 28 in the combustion section 26.

An annular plate 40 is attached to the diffuser casing 38 and extends substantially rearwardly and inwardly to shield the impeller 32 from the heat from the combustion section 26. Thus, the annular plate 40 and a portion of the diffuser casing 38 in combination form a stationary wall 42 spaced axially apart from a rear face (not indicated) of the impeller 32. An impeller rear cavity 44 is thus defined between the rear face of the impeller 32 and the stationary wall 42. A small gap (not indicated) is provided between a tip 46 of the impeller 32 and the inlet of the diffuser 30 such that the impeller rear cavity 44 is in fluid communication at the impeller tip 46 with pressurized air from the impeller tip 46 to allow a pressurized air flow from the impeller tip 46 into the impeller rear cavity 44. The pressurized air flow pressurizes the impeller rear cavity 44 to cause a forward force on the impeller 32 and thus a thrust load on the high pressure spool assembly 20. The pressurized air flow within the impeller rear cavity 44 is extracted therefrom at an inner periphery 48 of the annular plate 40 which is located radially inwardly away from the impeller tip 46. The extracted air flow from the impeller rear cavity 44 is directed to a low pressure region of the engine which is in fluid communication with the impeller rear cavity 44, for use of an air system flow demand.

The pressurized air flow introduced at the impeller tip 46 into the impeller rear cavity 44 has a relatively high tangential velocity which is produced by and therefore has the same rotational direction as the rotation of the impeller 32. The tangential direction of the pressurized air entering the impeller rear cavity 44 is illustrated by arrows 50 in FIG. 3. Arrows 51 illustrate the pressurized air flow extracted from the impeller rear cavity 44. The angular momentum carried by the pressurized air flow decreases to a certain degree when passing through the impeller rear cavity 44 from the impeller tip 46 (the outer radius of the cavity) to the inner periphery 48 of the annular plate 40 (the inner radius of the cavity) due to the drag of the rotor/stator surfaces, which produces a static pressure gradient between the outer/inner radii as a function of the vortex strength. The higher the vortex strength, the lower average static pressure on the rear face of the impeller 32. Therefore, control of the tangential velocity of the pressurized air flow passing through the impeller rear cavity 44 can be effectively used to adjust the average static pressure generated on the rear face of the impeller 32 and thus a thrust load on the high pressure compressor spool assembly 20.

In this embodiment there is provided a plurality of velocity interfering members attached to the stationary wall 42, such as ribs 52 protruding axially into the impeller rear cavity 44 to reduce the tangential velocity of the pressurized air flow within the cavity. The ribs 52 preferably extend radially and inwardly, and are circumferentially spaced apart one from another. The ribs 52 may be positioned at any radial locations for the convenience of the configuration of the stationary wall 42 which is formed as a combination of the annular plate 44 and an outer radial portion of the diffuser casing 38 in this embodiment. However, the stationary wall 42 can also be of other configurations in different types of engines. It may be chosen to position the ribs 52 at an outer radial location, radially adjacent to the impeller tip 46 where the pressurized air flow has the most angular momentum strength. The pressurized air flow 50 entering the impeller rear cavity 44 impinges on the ribs 52 and thus the tangential velocity of the air pressurized air flow 50 is reduced, thereby reducing the static pressure radial gradient and increasing the average static pressure within the impeller rear cavity 44. A desirable increase of the thrust load on the high pressure spool assembly 20 can be achieved by selection of the number, radial location and radial size of the ribs 52.

Alternative to velocity interfering members, such as ribs 52, the stationary wall 42 can be provided with a plurality of holes 54 through which the impeller rear cavity 44 is in fluid communication with the combustion section 26 such that the pressurized air (P3 air) around the combustor 28 is directed into the impeller rear cavity 44. The holes 54 extend axially and tangentially in a direction substantially opposite to the tangential velocity of the pressurized air flow 50 in order to direct the air flow from the combustion section 26 therethrough into the impeller rear cavity 44 (air flow direction indicated by arrow 56) in a direction substantially opposite to the tangential direction of the pressurized air flow 50 entering the impeller rear cavity 44 at the impeller tip 46. Therefore, the angular momentum of both pressurized air flows 50, 56 will act on each other to reduce the angular momentum of the total pressurized air contained within the impeller rear cavity 44 and thus the static radial pressure gradient, resulting in a thrust load increase on the high pressure spool assembly 20, similar to the result provided by the ribs 52. A desired thrust load increase is achieved by the selection of the number, size and radial location of the holes 54. The holes 54 can be positioned at any radial location in the stationary wall 42 but it is preferable to position the holes 54 radially adjacent to the impeller tip 46.

It should be noted that the ribs 52 and the holes 54 may both be included in one embodiment in combination in order to achieve a desired thrust load increase adjustment on the high pressure spool assembly 20.

Figure 4:
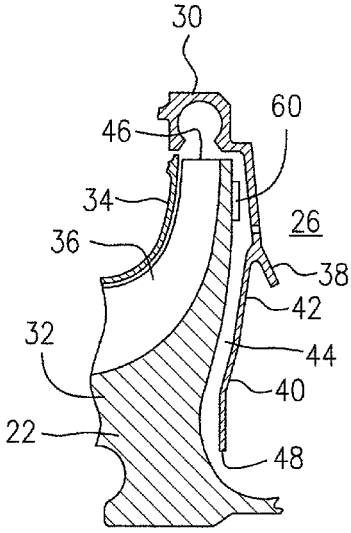
FIG. 4 is a partial cross-sectional view of an apparatus according to another embodiment of the present invention, for adjusting a thrust load on a rotor assembly of the gas turbine engine of FIG. 1.
Figure 5:
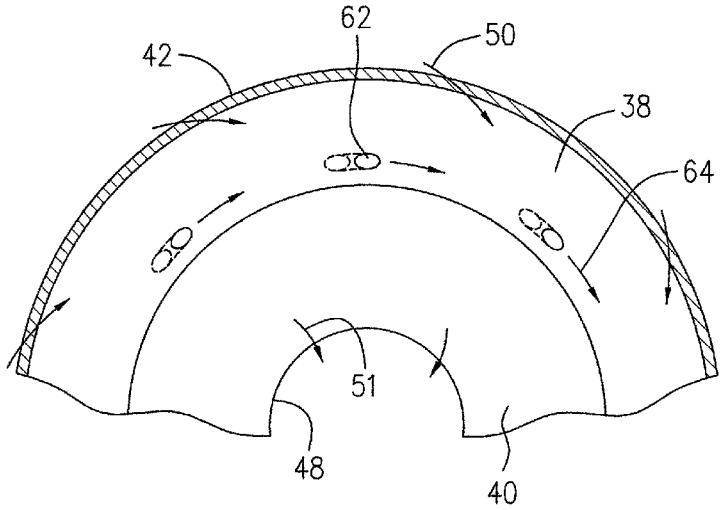
FIG. 5 is a partial front elevational view of a stationary wall used in the apparatus of FIG. 4.

Referring to FIGS. 1 and 4-5, another embodiment of the present invention is described for adjusting a thrust load on a rotor assembly of a gas turbine engine. The components and features of this embodiment similar to those of the embodiment shown in FIGS. 1-3 are indicated by the same numerals and will not be redundantly described.

In certain cases, it may be desirable to reduce rather than increase a thrust load on a rotor assembly, for example the high pressure spool assembly 20 of the gas turbine engine. For this purpose, a plurality of velocity interfering members such as ribs 60 are provided on the rear face of the impeller 32 to rotate together with the impeller. The ribs 60, similar to the ribs 52, extend radially and inwardly and protrude axially into the impeller rear cavity 44. It is desirable to position the ribs 60 circumferentially equally apart one from another in order to maintain the rotational balance of the impeller 32. The ribs 60 rotate in the direction of the tangential velocity of the pressurized air flow 50 which enters the impeller rear cavity 44 at the impeller tip 46. The ribs 60 push the pressurized air flow 50 in the impeller rear cavity 44 to overcome the drag force caused by the surface of the stationary wall 42, thereby maintaining the tangential velocity thereof, resulting in an increase in the static radial pressure gradient and thus reducing the average static pressure within the cavity. A decrease in thrust load on the rotor assembly is thereby achieved. For a particularly desired decrease of the thrust load on the rotor assembly, the number, size and radial location of the interfering member such as the ribs 60 should be selected.

Alternative to the ribs 60, a plurality of holes 62 are provided in the stationary wall 42 through which the impeller rear cavity 44 is in fluid communication with the combustion section 26, for directing pressurized air surrounding the combustor 28 into the impeller rear cavity 44. In contrast to the holes 54 in FIG. 3, the holes 62 extend axially and tangentially in a direction substantially the same as the direction of the tangential velocity of the pressurized air flow 50 in order to direct an air flow indicated by arrows 64 therethrough into the impeller rear cavity 44. The angular momentum carried by the pressurized air flow 64 is added to the pressurized air flow 50 entering the impeller rear cavity 44 at the impeller tip 46 to help the latter overcome the drag force caused by the surface of the stationary wall 42, thereby resulting in an increase in the static radial pressure gradient and thus reducing the average static pressure within the impeller rear cavity 44. This provides a similar function as the ribs 60 to reduce the thrust load on the rotor assembly. The holes 62 are preferably circumferentially spaced apart one from another and are preferably positioned adjacent to the impeller tip 46 in order to more effectively affect the pressurized air flow 50 entering the impeller rear cavity 44. Selection of the number, size and radial location of the holes 60 can achieve a particularly desired result of thrust load reduction on the rotor assembly.

It should be noted that the ribs 60 and the holes 62 can both be used in one embodiment in combination to provide a desired result.

The above description is meant to be exemplary only, and one skilled in the art will recognize that changes may be made to the embodiments described without departure from the scope of the invention disclosed. For example, the present invention can be applicable to a rotor assembly of a gas turbine engine of any type provided that the rotor assembly has a configuration similar to that described, although a turbofan engine and a high pressure spool are described as an example of the present invention. Configurations other than the described ribs can be attached to either a stationary wall or a rotational wall to protrude into the cavity in order to interfere with the tangential velocity of the pressurize air flow entering the cavity, according to the present invention. Still other modifications which fall within the scope of the present invention will be apparent to those skilled in the art, in light of a review of this disclosure, and such modifications are intended to fall within the appended claims.

The invention claimed is:

1. An apparatus for adjusting a thrust load on a rotor assembly of a gas turbine engine, the rotor assembly including a compressor having an impeller for pressurizing air in the engine, the apparatus comprising:

an impeller rear cavity defined between a rear face of the impeller and a stationary wall spaced axially apart from the rear face of the impeller, the impeller rear cavity being in fluid communication at a tip of the impeller with pressurized air from the impeller tip to introduce a pressurized air flow with a tangential velocity from the impeller tip into the impeller rear cavity; and a plurality of circumferentially spaced interfering members affixed within the impeller rear cavity and protruding from the stationary wall into the impeller rear cavity, for directly interfering with the tangential velocity of the pressurized air flow to affect an average static pressure of the pressurized air flow within the impeller rear cavity.

2. The apparatus as defined in claim 1 wherein the interfering members are located radially adjacent to the impeller tip in the impeller rear cavity.

3. The apparatus as defined in claim 1 wherein the interfering members each extend radially.

4. The apparatus as defined in claim 1 wherein the impeller rear cavity is in fluid communication at a location radially, inwardly away from the impeller tip, with a low pressure region for extracting an air flow from the impeller cavity.

5. A gas turbine engine comprising:

a rotor assembly including a shaft, a turbine and a compressor affixed to the shaft, the compressor having an impeller for pressurizing air in the engine;

a combustion section in fluid communication with pressurized air from the compressor;

a cavity defined between a rear face of the impeller and a stationary wall spaced axially apart from the rear face of the impeller, the cavity being in fluid communication at a tip of the impeller with pressurized air from the impeller tip to introduce a pressurized air flow with a tangential velocity from the impeller tip into the cavity, the cavity being in fluid communication at a location radially, inwardly away from the impeller tip with a low pressure region for extracting an air flow from the cavity; and a plurality of holes extending axially and tangentially through the stationary wall and being in fluid communication with the combustion section for directing a pressurized air flow from the combustion section into the cavity in a direction substantially opposite to the tangential velocity of the pressurized air flow from the impeller tip into the cavity to reduce the tangential velocity of the pressurized air flow within the cavity.

6. The gas turbine engine as defined in claim 5 therein the holes are circumferentially spaced apart one from another.

7. The gas turbine engine as defined in claim 5 wherein the holes are located radially adjacent to the impeller tip.

8. A method for adjusting a thrust load on a rotor assembly of a gas turbine engine, the rotor assembly including a compressor having an impeller for pressurizing air in the engine, the compressor defining a cavity between a rear face of the impeller and a stationary wall spaced axially apart from the rear face of the impeller, to introduce a pressurized air flow with a tangential velocity from the impeller tip into the cavity, the method comprising a step of injecting a high pressure air flow through at least one opening in the stationary wall into the cavity in a direction selected to be substantially the same as or opposite to a direction of the tangential velocity of the pressurized air flow introduced from the impeller tip into the cavity, depending on a desired adjustment result of the thrust load.

9. The method as defined in claim 8 wherein the selected direction is substantially the same as the direction of the tangential velocity of the pressurized air flow introduced from the impeller tip into the cavity in order to decrease the thrust load on the rotor assembly.

10. The method as defined in claim 8 wherein the selected direction is substantially opposite to the direction of the tangential velocity of the pressurized air flow introduced from the impeller tip into the cavity in order to increase the thrust load on the rotor assembly.

* * * * *